US005260157A

United States Patent [19]

Mizuta et al.

[11] Patent Number: 5,260,157

[45] Date of Patent: Nov. 9, 1993

[54] ELECTROPHOTOGRAPHIC PHOTOSENSITIVE ELEMENT COMPRISING A SURFACE PROTECTIVE LAYER COMPRISING AN ETHERIFIED MELAMINE-FORMALDEHYDE RESIN

[75] Inventors: Yasufumi Mizuta; Akihiko Kawahara; Kaname Nakatani; Nariaki Tanaka, all of Osaka, Japan

[73] Assignee: Mita Industrial Co., Ltd., Osaka, Japan

[21] Appl. No.: 599,858

[22] Filed: Oct. 19, 1990

[30] Foreign Application Priority Data

Oct. 20, 1989 [JP] Japan ..... 1-274413
Oct. 20, 1989 [JP] Japan ..... 1-274414
Oct. 20, 1989 [JP] Japan ..... 1-274415

[51] Int. Cl.[5] ..... G03G 5/147
[52] U.S. Cl. ..... 430/66; 430/67
[58] Field of Search ..... 430/66, 67, 56, 531, 430/961; 428/447

[56] References Cited

U.S. PATENT DOCUMENTS 4,288,357 9/1981 Kanazawa et al. ..... 524/720
4,409,309 10/1983 Oka ..... 430/65
5,066,698 11/1991 Hazan et al. ..... 524/269

FOREIGN PATENT DOCUMENTS 63-00271 7/1988 Japan .
62213568 3/1989 Japan .

OTHER PUBLICATIONS

Japanese Patent Gazette Section CH, Week 8807 Mar. 30, 1988, JP 63-002071.

*Primary Examiner*—Marion E. McCamish
*Assistant Examiner*—Rosemary Ashton
*Attorney, Agent, or Firm*—Cushman, Darby & Cushman

[57] ABSTRACT

An electrophotographic photosensitive element comprising a photosensitive layer and a surface protective layer on the photosensitive layer, the surface protective layer comprising a thermosetting silicone resin, and a methyl-butyl etherified melamine-formaldehyde resin in an amount of from 0.1 to 30 parts by weight per 100 parts by weight of the non-volatile solid components of the thermosetting silicone resin, an electrophotographic photosensitive element comprising a photosensitive layer and a surface protective layer on the photosensitive layer, the surface protective layer comprising a thermosetting silicone resin, and an acrylic copolymer having an average molecular weight of 6,000 or less in an amount of from 0.1 to 30 parts by weight per 100 parts by weight of the non-volatile solid components of the thermosetting silicone resin, and an electrophotographic photosensitive element comprising a photosensitive layer and a surface protective layer on the photosensitive layer, the surface protective layer containing a thermosetting silicone resin, a methyl etherified melamine-formaldehyde resin and/or a methyl-butyl mixed etherified melamine-formaldehyde resin in an amount of from 0.1 to 50 parts by weight per 100 parts by weight of the non-volatile solid components of the thermosetting silicone resin, and a thermoplastic resin in an amount of from 1 to 11 wt % to a total amount of the non-volatile solid components of the thermosetting silicone resin and the methyl etherified melamine-formaldehyde resin and/or the methyl-butyl mixed etherified melamine-formaldehyde resin.

12 Claims, 1 Drawing Sheet

ELECTROPHOTOGRAPHIC PHOTOSENSITIVE ELEMENT COMPRISING A SURFACE PROTECTIVE LAYER COMPRISING AN ETHERIFIED MELAMINE-FORMALDEHYDE RESIN

FIELD OF THE INVENTION

The present invention relates to a coating composition suitable for use as a surface protection layer. The present invention also relates to an electrophotographic photosensitive element, more particularly to an electrophotographic photosensitive element which has a surface protective layer made up of this coating composition.

BACKGROUND OF THE INVENTION

In an image-forming apparatus, such as a copying machine utilizing a so-called Carlson process, an electrophotographic photosensitive element is used. This element comprises a photosensitive layer on a base material which has an electric conductivity.

An electrophotographic photosensitive element repeatedly receives electric, optical, and mechanical shocks during the image-forming process. To protect the photosensitive element, a surface protective layer composed of a binder resin has been formed on the photosensitive layer thereof. This layer improves the durability of the photosensitive layer to these shocks.

A thermosetting silicone resin is generally used as the binder resin for improving the hardness of the surface protective layer. However, the use of the aforesaid heat-setting silicone resin presents the problem that the surface protective layer is brittle to sliding friction and is liable to be damaged. A variety of solutions have been attempted to try and avoid this problem.

One attempt was an electrophotographic photosensitive element which used a thermosetting silicone resin and a thermoplastic resin, such as polyvinyl acetate, as the binder resin for the surface protective layer. This type of protective layer is disclosed in JP-A-63-18354 (the term "JP-A" as used herein means an "unexamined published Japanese patent application"). An electrophoto-graphic photosensitive element which uses a thermosetting silicone resin and a butyl etherified melamine-formaldehyde resin as the binder resin is disclosed in JP-A-63-2071.

Also, an electrophotographic photosensitive element which uses a thermosetting silicone resin and an acrylic polymer as the binder resin is proposed in JP-A-60-3639.

However, when the thermosetting silicone resin and the thermoplastic resin are used as the binder resin for the surface protective layer, the sensitivity of the photosensitive element is insufficient. Another problem is found in the physical properties of the surface protective layer. The surface hardness of the combination binder resin is lower than the surface hardness of the thermosetting silicone binder resin alone. As a result, the surface protective layer is rather more likely to be damaged. In particular, the system using the thermosetting silicone resin and polyvinyl acetate has the problem that the coating composition for forming the surface protective layer lacks stability and when the coating composition is coated after the pot life, whitening occurs in the layer.

On the other hand, the binder resin made up of the thermosetting system and the butyletherified melamine-formaldehyde resin also has problems. The resins constituting the system are thermosetting resins and form a three dimensional structure having a high hardness after setting. Although the surface hardness of the surface protective layer becomes high, a large amount of voids are formed which become structural traps. These traps form between a silicone site and a melamine site in the protective layer owing to an insufficient compatibility between both of the sites. These traps result in the possibility of the binder resin having an adverse influence on the photosensitive characteristics of the electrophotographic photosensitive element. These adverse effects include the reduction of the charging characteristics, and lowering of the stability of the potential by repeated application of light exposure.

One attempt to avoid these problems was the use of a methyletherified melamine-formaldehyde resin in place of the butyletherified melamine-formaldehyde resin in the aforesaid system. The methyl etherified melamine-formaldehyde resin has a higher crosslinking property than the conventional butyletherified melamine-formaldehyde resin, and does not form a covalent bond with the Si—OH group of the thermosetting silicone resin during setting. Instead, it causes a sufficiently large molecular interaction with the Si—OH group of the thermosetting silicone resin, which improves the compatibility between the silicone site and the melamine site in the layer. This forms a compact layer having less structural traps. However, this system also has problems. When the methyl etherified melamine-formaldehyde resin is compounded with the thermosetting resin in an amount of over 15 parts by weight per 100 parts by weight of the non-volatile solid components of the latter resin in order to increase the electric conductivity of the layer using aromatic n electrons of melamine, a problem results. This problem is that the interaction between both of the resins is too strong which causes internal stress in the surface protective layer that forms cracks.

The above-described butyletherified melamine-formaldehyde resin does not have the strength interaction with the thermosetting silicone resin that the methyletherified melamine-aldehyde resin does. As a result, it was considered to use a combination of the butyletherified melamine-formaldehyde resin with the methyletherified melamine-formaldehyde resin. This combination could improve the electric conductivity of the layer by increases the number of aromatic $\pi$ electrons of melamine which were present. However, because both of the melamine-formaldehyde resins differed in setting or hardening temperature, a uniform layer could not be formed and there was the problem of cracks being formed.

The system of the thermosetting silicone resin and the acrylic copolymer is excellent in optical characteristics. The acrylic copolymer also has excellent compatibility with the thermosetting silicone resin compared to the use of polyvinyl acetate. The sensitivity characteristics of the coating are also improved compared to the aforesaid system using polyvinyl chloride. However, because the acrylic polymer which is used the aforesaid system has a high molecular weight between 8,000 and 60,000, the acrylic polymer is not easily dissolved in order to form a coating composition. Insufficient dissolution of the polymer in a coating composition creates additional problems. These problems include the inability to form a uniform layer, unevenness in the layer and white turbidity, of the layer. These defects reduce the transparency of the surface protective layer, which results in a deterioration of the sensitivity characteristics of the photosensitive element. They also may reduce the strength of the surface protective layer which results in the layer becoming brittle to sliding friction and susceptible to cracking.

SUMMARY OF THE INVENTION

The object of the present invention is to provide an electrophotographic photosensitive element possessing a surface protective layer which has less brittleness to sliding friction compared to the uses of a thermosetting silicone resin alone. The object of the present invention is also to achieve this without adverse effects on the photosensitive characteristics and physical properties of the electrophotographic photosensitive element, and to provide a protective layer with excellent electric conductivity.

It has been discovered that the object can be attained by the following embodiments in the present invention.

In a first embodiment, an electrophotographic photosensitive element comprises a photosensitive layer and a surface protective layer on the photosensitive layer, the surface protective layer comprising a thermosetting silicone resin, and a methyl-butyl mixed etherified melamine-formaldehyde resin in an amount of from 0.1 to 30 parts by weight per 100 parts by weight of the non-volatile solid components of the thermosetting silicone resin.

In a second embodiment, an electrophotographic photosensitive element comprises a photosensitive layer and a surface protective layer on the photosensitive layer, the surface protective layer comprising a thermosetting silicone resin, and an acrylic copolymer having an average molecular weight of 6,000 or less in an amount of from 0.1 to 30 parts by weight per 100 parts by weight of the non-volatile solid components of the thermosetting silicone resin.

In a third embodiment, an electrophotographic photosensitive element comprises a photosensitive layer and a surface protective layer on the photosensitive layer, the surface protective layer containing a thermosetting silicone resin, a methyl etherified melamine-formaldehyde resin and/or a methyl-butyl mixed etherified melamine-formaldehyde resin in an amount of from 0.1 to 50 parts by weight per 100 parts by weight of the non-volatile solid components of the thermosetting silicone resin, and a thermoplastic resin in an amount of from 1 to 11 wt % to a total amount of the non-volatile solid components of the thermosetting silicone resin and the methyl etherified melamine-formaldehyde resin and/or the methyl-butyl mixed etherified melamine-formaldehyde resin.

Another aspect of the present invention is that the aforesaid surface protective layers contain uniformly dispersed particles of an electrically conductive metal oxide. These particles serve as a conductivity imparting agent and are added by mixing a colloid solution of the conductive metal oxide particles with the coating composition before coating.

DETAILED DESCRIPTION OF THE INVENTION

Figure 1:
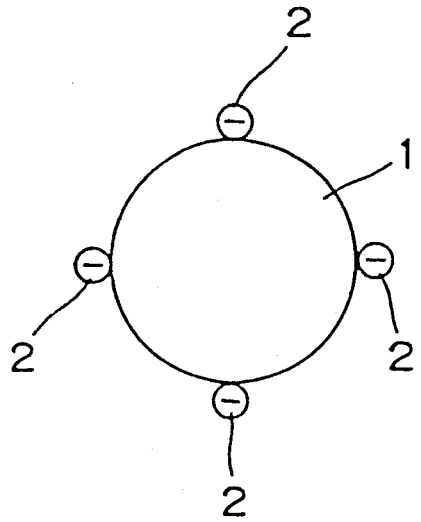
FIG. 1 is a schematic view showing a state of electrostatically charging a solid solution particle of tin oxide and antimony oxide by adsorbing silicon oxide particles on the surface of the solid solution.

Then, the present invention is described in detail.

In the first embodiment of the present invention, the electrophotographic photosensitive element comprises a photosensitive layer and a surface protective layer on the photosensitive layer, the surface protective layer comprising a thermosetting silicone resin, and a methyl-butyl mixed etherified melamine-formaldehyde resin in an amount of from 0.1 to 30 parts by weight per 100 parts by weight of the non-volatile solid components of the thermosetting silicone resin.

The surface protective layer of the electrophotographic photosensitive element is formed by coating a coating composition containing a thermosetting silicone resin and a methyl-butyl mixed etherified melamine-formaldehyde resin in an amount of from 0.1 to 30 parts by weight per 100 parts by weight of the non-volatile solid components of the thermosetting silicone resin on the photosensitive layer and setting the coated layer.

The first embodiment of the electrophotographic photosensitive element of the present invention, uses a methyl-butyl mixed etherified melamine-formaldehyde resin with the thermosetting silicone resin. This results in a uniform layer which does not cause cracks. The methyl-butyl mixed etherified melamine-formaldehyde resin has a high crosslinking property as compared to a conventional butyletherified melamine-formaldehyde resin. This does not cause covalent bonding with the Si—OH group of the thermosetting silicone resin during setting or hardening but does provide a sufficiently large molecular interaction with the Si—OH group. This effect improves the compatibility of the silicone site and the melamine site in the layer and results in the formation of a compact layer having less structural traps. The methyl-butyl mixed etherified melamine-formaldehyde resin does not have as strong a crosslinking property as the methyletherified melamine-formaldehyde resin. As a result, when a larger amount of the methyl-butyl mixed etherified melamine-formaldehyde resin is used in the surface protective layer, there is no trouble with the formation of cracks and the electric conductivity of the layer is improved by the presence of a large amount of aromatic $\pi$ electrons contained in the resin. Thus, the electrophotographic photosensitive element of the present invention has excellent sensitivity characteristics.

In addition, since both the resins constituting the surface protective layer are thermosetting resins which form a three dimensional structure during setting, the surface hardness of the surface protective layer becomes high after setting. Furthermore, as described above, both the resins have a high compatibility with each other which causes the surface protective layer to have a complicated and intermingled three dimensional structure after setting. This reduces the brittleness of the layer to sliding friction compared with the case where the thermosetting silicone resin is used alone.

The amount of the methyl-butyl etherified mixed melamine-formaldehyde resin is generally from 0.1 to 30 parts, preferably from 3 to 25 parts, more preferably from 5 to 15 parts by weight per 100 parts by weight of non-volatile solid components of the thermosetting silicone resin.

The amount of the methyl-butyl mixed etherified melamine-formaldehyde resin in the coating composition is limited to the range 0.1 to 30 parts by weight per 100 parts of the non-volatile solid components of the thermosetting silicone resin. The reasons for this are as follows. If the content of the methyl-butyl mixed etherified melamine-formaldehyde resin is less than 0.1 part by weight, the addition effect is not sufficiently obtained. This creates a problem of brittleness to sliding friction in the surface protective layer after setting. In addition, the content of aromatic $\pi$ electrons in the protective layer is deficient which deteriorates the sensitivity characteristics. On the other hand, if the content of the methyl-butyl mixed etherified melamine-formaldehyde resin is greater than 30 parts by weight, the interaction between both of the resins is too strong. This causes an internal stress in the surface protective layer which results in cracks, and precludes the formation of a clear surface protective layer.

The thermosetting silicone resin contained in the coating composition is prepared by dissolving or dispersing in a solvent, as a non-volatile component, the hydrolyzed product (so-called organopolysiloxane) or the initial condensation reaction product of one or a mixture of silane series compounds such as organosilanes (e.g., tetra-alkoxysilane, trialkoxyalkylsilane, and dialkoxydialkylsilane) and organohalogensilanes (e.g., trichloroalkylsilane and dichlorodialkylsilane). Suitable alkoxy groups and alkyl groups for these silane series compounds are lower alkoxy and alkyl groups having from 1 to about 4 carbon atoms (e.g., a methoxy group, an ethoxy group, an isopropoxy group, a t-butoxy group, a glycidoxy group, a methyl group, an ethyl group, a glycidoxypropyl group) and complex groups made of same kinds of those exemplified above (e.g., a glycidoxypropyl group). Trifunctional polysiloxane singlely or a mixture of trifunctional polysiloxane and bifunctional polysiloxane is preferably used with melamine-formaldehyde resins in the first embodiment.

The pH value of the solution which the thermosetting silicone is dissolved in is preferably from 5.0 to 6.5.

Examples of the solvent which the non-volatile solid components of the thermosetting silicone resin is dissolved in according to the present invention include aliphatic hydrocarbons (e.g., isopropyl alcohol, n-hexane, octane, cyclohexane, etc.), aromatic hydrocarbons (e.g., benzene, toluene, etc.), halogenated hydrocarbons (e.g., dichloromethane, dichloroethane, carbon tetrachloride, chlorobenzene, etc.), ethers (e.g., dimethyl ether, diethyl ether, tetrahydrofuran, ethylene glycol dimethyl ether, ethylene glycol diethyl ether, diethylene glycol dimethyl ether, etc.), ketones (e.g , acetone, methyl ethyl ketone, cyclohexanone, etc.), esters (e.g., ethyl acetate, methyl acetate, etc.), dimethylformamide, and dimethylsulfoxide, etc. They may be used singly or as a mixture of them.

The methyl-butyl mixed etherified melamine-formaldehyde resin which is used with the thermosetting silicone resin is a mono- or hexamethylolmelamine, which is the reaction product of melamine and formaldehyde, at least one of the methylol groups of which is methyletherified and at least one of other methylol group is butyletherified, or the initial condensation reaction product, and the resin which is supplied as a liquid state or a syrup state is preferably used.

There is no particular restriction on the number average molecular weight of the methyl-butyl mixed etherified melamine-formaldehyde resin. However, when the molecular weight thereof is greater than 1500, the reactivity of the resin is lowered. Thus, it is preferred that the number average molecular weight of this resin is preferably from 1,000 to 1,500, more preferably from 1,200 to 1,400.

It is preferred that in this resin, the number of bonded formaldehydes per one melamine nucleus is from 3 to 6, 2 to 5 of which have been methyletherified and 1 or 2 of which have been butyletherified. If the number of the bonded formaldehydes per one melamine nucleus is less than 3, there is a possibility that the mechanical strength of the surface protective layer will be diminished. Also, if the number of the methyletherified formaldehydes is less than 2, the surface potential is greatly lowered by repeated light exposure. If the number of methyletherified formaldehydes is over 5, there is a possibility that the layer will be susceptible to cracking.

Furthermore, if the number of the butyletherified formaldehyde groups is less than 1, the layer susceptible to cracking. If the number is over 2, the surface potential is greatly lowered by repeated light exposure.

The amount of the melamine monomer having the number of bonded formaldehyde per one melamine nucleus of from 3 to 6, from 2 to 5 of which have been methyletherified and 1 or 2 of which have been butyletherified, in the total melamine-formaldehyde resin is preferably from 70 to 100% by weight.

In the second embodiment of the present invention, an electrophotographic photosensitive element comprises a photosensitive layer and a surface protective layer on the photosensitive layer, the surface protective layer comprising a thermosetting silicone resin, and an acrylic copolymer having an average molecular weight of 6,000 or less in an amount of from 0.1 to 30 parts by weight per 100 parts by weight of the non-volatile solid components of the thermosetting silicone resin. The surface protective layer of the electrophotographic photosensitive element is formed by coating a coating composition containing a thermosetting silicone resin and an acrylic polymer having an average molecular weight of not more than 6,000 in an amount of from 0.1 to 30 parts by weight per 100 parts by weight of the non-volatile solid components of the thermosetting silicone resin on the photosensitive layer and setting the coated layer.

In the second embodiment of the present invention, the electrophotographic photosensitive element has, as the feature thereof, a surface protective layer formed by using a coating composition comprising a thermosetting silicone resin and an acrylic polymer having an average molecular weight of not more than 6,000. The acrylic polymer is present in an amount of from 0.1 to 30 parts by weight per 100 parts by weight of the non-volatile solid components of the thermosetting silicone resin.

It is preferred that the surface protective layer contains uniformly dispersed particles of an electrically conductive metal oxide. The addition of the metal oxide imparts electric conductivity to the protective layer. The metal oxides are preferably added by mixing a colloid solution of the conductive metal oxide particles with the coating composition for the surface protective layer prior to coating.

In the electrophotographic photosensitive element of the present invention, which contains the acrylic polymer, the average molecular weight of the acrylic polymer being contained in the coating composition should be not more than 6,000. This allows the polymer to be easily dissolved in the coating composition. The resulting surface protective layer is uniform and has excellent optical characteristics and physical properties.

The content of the acrylic polymer in the coating composition should be limited to the range of 0.1 to 30 parts by weight per 100 parts by weight of the non-volatile solid component of the thermosetting silicone resin.

If the content of the acrylic polymer is less than 0.1 part by weight, the addition effect thereof is not sufficient and the surface protective layer is susceptible to cracking and becomes brittle to sliding friction. On the other hand, if the amount of the acrylic polymer is over 30 parts by weight, the dissolution of the polymer in the coating composition becomes difficult. This causes the surface protective layer to become uneven, the transparency of the layer to be reduced, and the sensitivity characteristics of the photosensitive element to be deteriorated. The amount of the acrylic polymer is preferably from 1 to 20 parts, more preferably from 3 to 15 parts, by weight.

Suitable thermosetting silicone resins which can be used with the acrylic polymer in the present invention, are the thermosetting silicone resins described hereinbefore for use in the coating composition containing the thermosetting silicone resin and the methyl-butyl mixed etherified melamineformaldehyde resin. Trifunctional polysiloxanes are preferably used in the second embodiment.

Suitable acrylic polymers for use with the thermosetting resin, include homopolymers or copolymers composed of acrylic monomers. These monomers include, methyl acrylate, methyl methacrylate, ethyl acrylate, ethyl methacrylate, butyl acrylate, and butyl methacrylate. Preferred examples of the acrylic polymer include polymethyl methacrylate, polymethyl acrylate, and copolymers thereof.

The average molecular weight of the acrylic polymer is limited to not more than 6,000 in the present invention. If the average molecular weight thereof is over 6,000, the solubility of the polymer in the coating composition is lowered, and a uniform layer can not be formed. The average molecular weight of the acrylic polymer is preferably from 4,000 to 6000, more preferably from 5,000 to 6,000.

In the third embodiment, an electrophotographic photosensitive element comprises a photosensitive layer and a surface protective layer on the photosensitive layer, the surface protective layer containing a thermosetting silicone resin, a methyl etherified melamine-formaldehyde resin and/or a methyl-butyl mixed etherified melamine-formaldehyde resin (hereinafter referred to as a specific etherified melamine-formaldehyde resin) in an amount of from 0.1 to 50 parts by weight per 100 parts by weight of the non-volatile solid components of the thermosetting silicone resin, and a thermoplastic resin in an amount of from 1 to 11 wt % to a total amount of the non-volatile solid components of the thermosetting silicone resin and the specific etherified melamine-formaldehyde resin. The specific etherified melamine-formaldehyde resin is used in an amount of generally from 0.1 to 50 parts, preferably from 5 to 50 parts, by weight per 100 parts by weight of the non-volatile solid components of the thermosetting silicone resin.

The surface protective layer of the electrophotographic photosensitive element is formed by coating a coating composition containing a thermosetting silicone resin, a methyl etherified melamine-formaldehyde resin and/or a methyl-butyl mixed etherified melamine-formaldehyde resin in an amount of from 0.1 to 50 parts by weight per 100 parts by weight of the non-volatile solid components of the thermosetting silicone resin, and a thermoplastic resin in an amount of from 1 to 11 wt % to a total amount of the non-volatile solid components of the thermosetting silicone resin and the methyl etherified melamine-formaldehyde resin and/or the methyl-butyl mixed etherified melamine-formaldehyde resin on the photosensitive layer and setting the layer.

In the electrophotographic photosensitive element comprising the construction according to the present invention, the combination use of the specific etherified melamine-formaldehyde resin and the thermoplastic resin can increase the added amount of the methyl-butyl mixed etherified melamine-formaldehyde resin and the added amount of the methyl etherified melamine-formaldehyde resin to an extent that a methyl-butyl mixed etherified melamine-formaldehyde resin can be added, though the added amount of the methyl etherified melamine-formaldehyde resin is less than that of the methyl-butyl mixed etherified melamine-formaldehyde resin in the past.

The thermoplastic resin in the coating composition functions as a buffer which decreases an internal stress in the surface protective layer, therefore, even if a great amount of the specific etherified melamine-formaldehyde resin is added in a layer, problems such as cracking, etc. do not generate. Accordingly, the electrophotographic photosensitive element according to the present invention is superior in photosensitive performance.

In a coating solution according to the present invention, the reasons that the content of the specific etherified melamine-formaldehyde resin is limited to from 0.1 to 50 parts by weight per 100 parts by weight of the non-volatile solid components of the thermosetting silicone resin, and the content of the thermoplastic resin is limited to from 1 to 11 wt % to the total amount of the non-volatile solid components of the thermosetting silicone resin and the specific etherified melamine-formaldehyde resin are as follows. That is, if the content of the specific etherified melamine-formaldehyde resin is less than 0.1 parts by weight, a problem of brittleness to sliding friction occurs in the surface protective layer after setting, and also the content of aromatic $\pi$ electrons in the layer is deficient to deteriorate the sensitivity characteristics. On the other hand, if the content of the specific etherified melamine-formaldehyde resin is over 50 parts by weight, an internal stress occurs in the surface protective layer to cause cracks, etc., and a clear surface protective layer can not be obtained, regardless of the added proportion of the thermosetting resin. Furthermore, if the content of the thermoplastic resin is less than 1% by weight, an internal stress occurs in the surface protective layer to cause cracks with increase of the content of the specific etherified melamine-formaldehyde resin, and thus, a clear surface protective layer can not be obtained. If the content of the thermoplastic resin is over 11% by weight, the surface protective layer is softened and becomes white-turbid and the sensitivity characteristics is deteriorated.

As the specific etherified melamine-formaldehyde resin used together with the thermosetting silicone resin, examples of the methylbutyl mixed etherified melamine-formaldehyde resin include those mentioned above. On the other hand, the methyl etherified melamine-formaldehyde resin is a mono- or hexa-methylolmelamine, which is the reaction product of melamine and formaldehyde, at least one of the methylol groups of which is methyletherified, or the initial condensation reaction product, and the resin which is supplied as a liquid state or a syrup state is preferably used.

There is not particular restriction on the number average molecular weight of the methyl etherified melamine-formaldehyde resin but since the number average molecular weight thereof is over 1,500, the reactivity thereof is lowered, it is preferred that the number average molecular weight is 1,500 or less. Also, it is preferred that in the resin, the number of bonded formaldehydes per one melamine nucleus is from 3 to 6, from 3 to 6 of which have been methyletherified. If the number of the bonded formaldehydes per one melamine nucleus is less than 3, there is a possibility that the mechanical strength of the surface protective layer deteriorates. Also, if the number of the methyletherified formaldehydes is less than 3, the coating composition for the surface protective layer is inferior in stability.

As thermoplastic resins to be contained together with the thermosetting silicone and the specific etherified melamine-formaldehyde resin, styrene series polymers, acrylic polymers, styreneacryl series copolymers, olefinic polymers (e.g., polyethylene, an ethylene-vinyl acetate copolymer, chlorinated polyethylene, polypropylene, and ionomer), polyvinyl chloride, vinyl chloride-vinyl acetate copolymers, polyvinyl acetate, saturated polyester, polyamide, thermoplastic polyurethane resins, polycarbonate, polyarylate, polysulfone, ketone resins, polyvinylbutyral resins, and polyether resins and various artificial resins can be used. Among them, the acrylic copolymers can be preferably used. The use of methyl polymethacrylate, methyl polyacrylate, and copolymers thereof having average molecular weigh of 6,000 or less is more preferable and results in high photosensitivity of the electrophotographic photosensitive element due to high optical characteristics of these acryl based copolymers. The use of polyvinylacetate results in improvement in brittleness of the surface protective layer, superiority in mechanical strength and long-lifetime use. In addition, the acryl based copolymers and polyvinylacetates can be used independently, in combination thereof, or with the other thermoplastic resins.

In the present invention, the content of the non-volatile solid components of the thermosetting silicone resin in the surface protective layer is preferably from 50 to 71 wt %, more preferably from 55 to 68 wt %.

Suitable solvents for forming the coating composition for the surface protective layer in the present invention include aliphatic hydrocarbons, such as isopropyl alcohol, n-hexane, octane, and cyclohexane; aromatic hydrocarbons such as benzene, and toluene; halogenated hydrocarbons such as dichloromethane, dichloroethane, carbon tetrachloride, chlorobenzene; ethers such as dimethyl ether, diethyl ether, tetrahydrofuran, ethylene glycol dimethyl ether, ethylene glycol diethyl ether, and diethylene glycol dimethyl ether; ketones such as acetone, methyl ethyl ketone, cyclohexanone; esters such as ethyl acetate, and methyl acetate; dimethylformamide; dimethylsulfoxide. The solvents may be used alone or as a mixture of solvents. Preferred examples of the solvent include lower alcohols such as isopropyl alcohol and methanol.

The coating composition is coated on a photosensitive layer by means of dip coating method, spray coating method, spin coating method, roller coating method, plate coating method or bar coating method, etc. and set to form a surface protective layer.

The coating composition coated on the photosensitive layer is set at a heat temperature of generally from 90° to 150 ° C., preferably from 110° to 150° C. for generally from 30 to 180 minutes, preferably from 60 to 120 minutes in the present invention.

The coating composition for the surface protective layer can be set or hardened by heating alone without the use of catalysts according to suitable heating conditions. However, for smooth and uniform finishing of the setting reaction, a catalyst is frequently used.

Suitable setting catalysts, include inorganic acids, organic acids, alkalis (e.g., amines). Also, if necessary, conventional setting aids can be used.

In this invention, it is preferable, in order to facilitate the injection of static charges into the lower layer during an image-forming process, that an electric conductivity imparting agent be dispersed in the surface protective layer. This is true for the layer composed of the thermosetting silicone resin and the methyl-butyl mixed etherified melamine-formaldehyde resin, for the layer composed of the thermosetting silicone resin and the acrylic copolymer, and for the layer composed of the thermosetting silicone resin and the thermoplastic resin.

The content of the conductivity imparting agent in the surface protective layer is generally from 1 to 60 parts, preferably from 20 to 50 parts by weight per 100 parts of the non-volatile solid components of the resins.

Suitable conductivity imparting agents, include electrically conductive metal oxides such as simple metal oxides (e.g., tin oxide, titanium oxide, indium oxide, and antimony oxide) and solid solutions of tin oxide and antimony oxide. The surface protective layer contains the conductive metal oxide, preferably in the form of fine particles.

The conductive metal oxide is generally as fine particle state mixed by stirring it into the coating composition as fine particle prior to setting. This results in it being dispersed in the surface protective layer. However, because the conductive metal oxide in a fine particle state is likely to aggregate and a long period of stirring is required in order to uniformly disperse the particles in the coating composition, it is preferred that the fine particles of the conductive metal oxide are mixed with the coating composition while in a colloid solution. In the colloid solution, the fine particles of the conductive metal oxide repel each other by their surface charges. This prevents the fine particles from aggregating in the coating composition. Thus, mixing the colloid solution with the coating composition allows the fine particles to be uniformly dispersed in the coating composition.

One method of producing the colloid solution of the electrically conductive metal oxide varies according to the type of the conductive metal oxide. For example, a colloid solution of antimony pentoxide ($Sb_2O_5$) can be prepared by mixing anhydrous antimony trioxide and nitric acid, and after heating, successively adding thereto an α-hydroxycarboxylic acid and an organic solvent such as N-dimethylformamide (DMF) in that order. The water by-product can be removed by evaporation (JP-A-47-11382). Another method consists of mixing a monohydric or a di- or more-hydric alcohol, such as ethylene glycol, a hydrophilic organic solvent such as DMF, and an α-hydroxycarboxylic acid to a hydrogen halide, such as hydrogen chloride, etc. Antimony trioxide is dispersed in the mixture and oxidized with hydrogen peroxide in the dispersed state (JP-A-52-38495 and JP-A-52-38496).

Suitable dispersion mediums for preparing the antimony pentoxide colloid solution include: alcohols having less organisity, such as methanol, ethanol, n-propanol, iso-propanol, and butyl alcohol. These are preferably used so that the solvent does not corrode the lower photosensitive layer.

In the case of a colloid solution of the solid solution of tin oxide ($SnO_2$, SnO, etc.) and antimony oxide ($Sb_2O_5$, $Sb_2O_3$, etc), the colloid solution can be prepared, for example, by adsorbing silicon oxide particles (2) having particle sizes of about less than 5 n.m. onto the surface of a solid solution particle (1) as shown in FIG. 1. In the structure shown in FIG. 1, the silicon oxide particles (2) adsorbed on the surface of the solid solution particle (1) form an OH group by contact with a polar solvent as the dispersion medium and become negatively charged. This provides charges on the surface of the solid solution particle (1).

The solid solution particles of tin oxide and antimony oxide are usually formed by doping the fine particles of tin oxide with antimony. Although there is no particular restriction on the amount of antimony, the amount of antimony in the solid solution particles is preferably from 0.001 to 30% by weight, and more preferably from 5 to 20% by weight. If the content of antimony in the solid solution particles is less than 0.001% by weight or over 30% by weight, there is a possibility of not obtaining sufficient electric conductivity.

There is no particular restriction on the particle size of the solid solution particles, however, the particle sizes are preferably from 1 to 100 nm. If the particle sizes of the solid solution particles are less than 1 nm, the electric resistance of the surface protective layer becomes high. If the particle sizes are over 100 nm, there is a possibility of lowering stability in dispersion of the coating composition for the surface protective layer.

There is no particular restriction on the ratio of silicon oxide to the solid solution particle. This ratio is preferably not more than 10 parts by weight per 100 parts by weight of the solid solution particle. If the ratio of silicon oxide per 100 parts by weight of the solid solution particles is over 10 parts by weight, there is a possibility of not obtaining sufficient electric conductivity.

A polar solvent is used as the dispersion medium for creating the colloid solution of the solid solution particles. The polar solvent is used to negatively charge the silicon oxide. Suitable polar solvents include alcohols which are excellent in compatibility with the coating composition for the surface protective layer and have no possibility of corroding the lower photosensitive layer. Example of these alcohols include methanol, ethanol, n-propanol, iso-propanol, and butyl alcohol.

In the present invention, thermosetting resins or thermoplastic resins other than the aforesaid resins can be used together with the aforesaid resins as the binder resin constituting the surface protective layer. These components should be present in a range to avoid spoiling the properties of the protective layer.

Examples of such resins include setting acrylic resins, alkyd resins, unsaturated polyester resins, diallylphthlate resins, phenol resins, urea resins, benzoguanamine resins, other melamine resins than the methyl-butyl mixed etherified series and butyletherified series melamine resins, styrene series polymers, acrylic polymers, styrene-acryl series copolymers, olefinic polymers (e.g., polyethylene, an ethylene-vinyl acetate copolymer, chlorinated polyethylene, polypropylene, and ionomer), polyvinyl chloride, vinyl chloride-vinyl acetate copolymers, polyvinyl acetate, unsaturated polyester, polyamide, thermoplastic polyurethane resins, polycarbonate, polyarylate, polysulfone, ketone resins, polyvinylbutyral resins, and polyether resins. Preferred examples are setting acrylic resins, styrene-acryl copolymer, polyvinylacetate, polyurethane, and polycarbonate.

In the present invention, the surface protective layer may further contain various additives such as conventionally known sensitizers (e.g., terphenyl, halonaphthoquinones, and acylnaphthylene), fluorene series compounds (e.g., 9-(N,N-diphenylhydrazino)fluorenone and 9-carbazolyliminofluorene), electric conductivity imparting agents, amine series and phenol series anti-oxidants, deterioration inhibitors (e.g., benzophenone series ultraviolet absorbents), plasticizers, etc.

The thickness of the surface protective layer is preferably in the range of from 0.1 to 10 μm, and more preferably in the range from 2 to 5 μm.

The electrophotographic photosensitive element of this invention can be made up of conventional materials and may use conventional structures for elements other than the surface protective layer.

First, electric conductive base materials suitable for use in this invention are provided.

The conductive base material has a proper form, such as a sheet or a drum, depending on the mechanism and structure of the image-forming apparatus on which the electrophotographic photosensitive element is mounted.

The conductive base material may be wholly made up of an electrically conductive material such as a metal.

Suitable materials which are usable as the electrically conductive material for the conductive base having this structure include metals such as aluminum, the surface of which has been almite-treated, untreated aluminum, copper, tin, platinum, gold, silver, vanadium, molybdenum, chromium, cadmium, titanium, nickel, palladium, indium, stainless steel, and brass.

Alternatively, the base material itself is constructed from a material which does not have electric conductivity and electric conductivity may be imparted to the surface thereof. Examples of this structure are those where a thin layer composed of a metal or other electrically conductive material, such as aluminum iodide, tin oxide, or indium oxide, is formed on the surface of a synthetic resin base material or a glass base material. This layer can be formed by a vacuum vapor deposition method and other suitable deposition methods. This structure has a sheet or foil of the metal material laminated to the surface of the synthetic resin molding or glass base material. Another type of this structure has a material which imparts electric conductivity injected into the surface of the synthetic resin molding or glass base material.

In addition, if necessary, a surface treatment may be applied to the electrically conductive base material with a surface treating agent, such as a silane coupling agent, a titanium coupling agent, in order to improve the adhesion of the photosensitive layer to the base.

The following discussion relates to photosensitive layer which is formed on the conductive base material.

As the photosensitive layer in the present invention, photosensitive layers having the following structures can be used. Generally this layer is composed of a semiconductor material, an organic material or a composite material thereof. The following four categories describe suitable photosensitive layers for use in the present invention:

(1) A single layer photosensitive layer composed of a semiconductor material.

(2) A single layer organic photosensitive layer which contains a charge generating material and a charge transfer material in a binder resin.

(3) A laminated organic photosensitive layer composed of a charge generating layer which contains a charge generating material in a binder resin and a charge transfer layer which contains a charge transfer material in a binder resin.

(4) A composite photosensitive layer composed of a charge generating layer which is made up of a semiconductive material and an organic charge transfer layer laminated thereon. Suitable semiconductor materials for use as the charge generating layer of the composite type photosensitive layer, and suitable materials for use as the photosensitive layer itself, include amorphous chalcogenites such as a-$As_2Se_3$, a-SeAsTe, amorphous selenium (a-Se), and amorphous silicon (a-Si). The photosensitive layer or the charge generating layer made up of the semiconductor material can be formed using conventional thin layer-forming methods for example, vacuum evaporation methods, and glow discharging decomposition methods.

Suitable organic or inorganic charge generating materials for use as the charge generating layer of the single layer type or laminated type organic photosensitive layer, include: a powder of the above-illustrated semiconductor material; fine crystals of compounds made up of the elements belonging to groups II-VI of the periodic table, such as ZnO, CdS, etc.; pyrylium salts; azic compounds; bisazoic compounds; phthalocyanine series compounds; anthanthrone series compounds; perylene series compounds; indigo series compounds; triphenylmethane series compounds; threne series compounds; toluidine series compounds; pyrazoline series compounds; quinacridone series compounds; and pyrrolopyrrole series compounds.

Preferred materials of this type are, phthalocyanine compounds including aluminum phthalocyanine, copper phthalocyanine, metal free phthalocyanine, and oxotitanyl phthalocyanine. Each compound should have various crystal types such as $\alpha$-type, $\beta$-type, $\delta$-type, etc. A particularly preferred compound is the, metal free phthalocyanine and/or oxotitanyl phthalocyanine. These charge generating materials may be used alone or in combination with other charge transfer materials.

Other stable charge transfer materials contained in the charge transfer layer of the single layer or laminated organic photosensitive layer or the composite photosensitive layer include tetracyanoethylene; fluorenone series compounds such as 2,4,7-trinitro-9-fluorenone, nitro compounds such as dinitroanthracene, succinic anhydride; maleic anhydride; dibromomaleic anhydride; triphenylmethane series compounds; oxadiazole series compounds such as 2,5-di(4-dimethylaminophenyl)-1,3,4-oxadiazole, styryl series compounds such as 9-(4-diethyl-aminostyryl)anthracene, carbazole series compounds such as poly-N-vinylcarbazole, pyrazoline series compounds such as 1-phenyl-3-(p-dimethylaminophenyl)pyrazoline, amine derivatives such as 4,4,'4''-tris(N,N-diphenylamino) triphenylamine, conjugated unsaturated compounds such as 1,1-bis(4-diethylaminophenyl)-4,4-diphenyl-1,3-butadiene, hydrazone series compounds such as 4-(N,N-diethylamino)-benzaldehyde-N, N-diphenylhydrazone, nitrogen-containing cyclic compounds such as indole series compounds, oxazole series compounds, iso-oxazole series compounds, thiazole series compounds, thiadiazole series compounds, imidazole series compounds, pyrazole series compounds, pyrazoline series compounds, and triazole series compounds, and condensed polycyclic compounds.

These charge transfer materials can be used alone or in combination with other charge transfer materials. In addition, polymer materials having photoconductivity, such as poly-N-vinylcarbazole, etc., can be used as a binder resin for the photosensitive layer.

Also, in the single layer or laminated organic photosensitive layer, the charge transfer layer of these photosensitive layers, can contain additives including sensitizers, fluorene series compounds, antioxidants, ultraviolet absorbents, and plasticizers.

The content of the charge generating material in the single layer organic photosensitive layer is preferably in the range of from 2 to 20 parts by weight per 100 parts by weight of the binder resin. A particularly preferred amount is in the range from 3 to 15 parts by weight per 100 parts by weight of the binder resin. The content of the charge transfer material is preferably in the range of from 40 to 200 parts by weight per 100 parts by weight of the binder resin. A particularly preferred amount is from 50 to 100 parts by weight per 100 parts by weight of the binder resin.

If the content of the charge generating material is less than 2 parts by weight or the content of the charge transfer material is less than 40 parts by weight, the sensitivity of the photosensitive element becomes insufficient and the residual potential becomes large. If the content of the charge generating material is over 20 parts by weight or the content of the charge transfer material is over 200 parts by weight, the abrasion resistance of the photosensitive element becomes insufficient.

The single layer photosensitive layer may have any proper thickness, but the preferred thickness is usually in the range of from 10 to 50 $\mu$m. A particularly preferred thickness is from 15 to 25 $\mu$m.

In the laminated organic photosensitive layer, the content of the charge generating material in the charge generating layer is preferably in the range of from 5 to 500 parts by weight per 100 parts by weight of the binder resin. A particularly preferred range is from 10 to 250 parts by weight per 100 parts by weight of the binder resin. If the content of the charge generating material is less than 5 parts by weight, the charge generating ability is too low. If the content is over 500 parts by weight, the adhesion of the layer to the adjacent layer or the base material is decreased.

The thickness of this type of charge generating layer is preferably in the range of from 0.01 to 3 $\mu$m, more preferably from 0.1 to 2 $\mu$m.

The amount of the charge transfer material in the charge transfer layer in the laminated organic photosensitive layer or the composite type photosensitive layer is preferably in the range of from 10 to 500 parts by weight per 100 parts by weight of the binder resin. A particularly preferred amount is from 25 to 200 parts by weight per 100 parts by weight of the binder resin. If the amount of the charge transfer material is less than 10 parts by weight, the charge transfer ability is insufficient. If the amount of the charge transfer material is over 500 parts by weight, the mechanical strength of the charge transfer layer is lowered.

The thickness of the charge transfer layer is preferably in the range of from 2 to 100 μm, and more preferably in the range from 5 to 30 μm.

The organic layers described above, such as the single layer or laminated organic photosensitive layer, the charge transfer layer in the composite type photosensitive layer, and the surface protective layer, can be formed by preparing a coating composition for each layer containing these components. The coating composition can be coated on a conductive base material or a photosensitive layer formed on a conductive base material so as to form the desired layer structure.

Various solvents can be used to prepare these coating compositions depending on the kind of the binder resins which are being used.

Suitable solvents include aliphatic hydrocarbons such as n-hexane, octane, and cyclohexane; aromatic hydrocarbons such as benzene, xylene, toluene and halogenated hydrocarbons such as dichloromethane, carbon tetrachloride, chlorobenzene, and methylene chloride; alcohols such as methanol, ethanol, isopropanol, allyl alcohol, cyclopentanol, benzyl alcohol, furfuryl alcohol, diacetone alcohol, ethers such as dimethyl ether, diethyl ether, tetrahydrofuran, ethylene glycol dimethyl ether; and ethylene glycol diethyl ether, diethylene glycol dimethyl ether; ketones such as acetone, methyl ethyl ketone, methyl isobutyl ketone, and cyclohexanone; dimethylformamide; and dimethyl sulfoxide. These solvents can be used alone or in combination with one another.

The coating composition may further contain a surface active agent, and/or a leveling agent, to improve properties, such as the dispersibility, and the coating property of the composition.

Furthermore, the coating composition can be prepared by a conventional method. These include the use of a mixer, a ball mill, a paint shaker, a sand mill, an attritor, and a ultrasonic dispersing means.

The invention is described in more detail by referring to the following examples. However, these examples are merely provided to exemplify the claimed invention and do not serve to limit it in any way.

EXAMPLES 1 to 4, COMPARATIVE EXAMPLES 4 and 5

A coating composition for charge transfer layer composed of 100 parts by weight of Polyarylate (U-100, trade name, made by Unitika Ltd.) as a binder resin, 100 parts by weight of 4-(N,N-diethylamino)benzaldehyde-N,N-diphenylhydrazone as a charge transfer material, and 900 parts by weight of methylene chloride ($CH_2Cl_2$) as a solvent was prepared, and the coating composition was coated on an aluminum tube having an outer diameter of 78 mm and a length of 340 mm followed by drying by heating for 30 minutes at 90° C. to form a charge transfer layer having a thickness of about 20 μm.

Then, a coating composition for charge generating layer composed of 80 parts by weight of 2,7-dibromoanthanthrone (made by Imperial Chemical Industries, Limited) as a charge generating material, 20 parts by weight of metal free phthalocyanine (made by BASF A.G.) as a charge generating material, 50 parts by weight of polyvinyl acetate (Y5-N, trade name, made by The Nippon Synthetic Chemical Industry Co., Ltd.) as a binder resin, and 2,000 parts by weight of diacetone alcohol as a solvent was coated on the aforesaid charge transfer layer and dried by heating for 30 minutes at 110° C. to form a charge generating layer having a thickness of about 0.5 μm.

Then, 57.4 parts by weight of 0.02N hydrochloric acid was mixed with 36 parts by weight of isopropyl alcohol and after adding dropwise thereto slowly 80 parts by weight of methyltrimethoxysilane and 20 parts by weight of glycidoxypropylmethoxysilane while stirring at a temperature of from 20° to 25° C.. The resulting mixture was allowed to stand for one hour at room temperature to provide a solution of silane hydrolyzed product. Then, a methyl-butyl mixed etherified melamine-formaldehyde resin (Sumimal M65B, trade name, made by Sumitomo Chemical Company, Limited) was mixed with the silane hydrolyzed product solution in each amount shown in Table 1 shown below per 100 parts by weight of the non-volatile solid components in the silane hydrolyzed product solution to provide a coating composition for a surface protective layer.

| Sumimal M65B | |
|---|---|
| average molecular weight; | 1,400 |
| number of bonded formaldehyde; | 3 to 6 |
| number of formaldehyde methyletherified; | 1 to 2 |
| number of formaldehyde butyletherified; | 2 to 4 |

A fine powder of antimony-doped tin oxide (made by Sumitomo Cement Co., Ltd., solid solution particles of tin oxide and antimony oxide, containing 10% by weight antimony, particle size; 5 to 10 nm) was compounded with the aforesaid coating composition in an amount of 60 parts by weight per 100 parts by weight of the resin solid components in the coating composition and the resulting mixture was mixed in a ball mill for 150 hours. The mixture of the coating composition and the antimony doped tin oxide fine powder was coated on the charge generating layer and set by heating for one hour at 110° C. to form a surface protective layer having a thickness of about 2.5 μm. Six kinds of drum-type electrophotographic photosensitive elements were prepared with each having the lamination type photosensitive layer. Each coating of the coating compositions for the charge transfer layer, the charge generating layer and the surface protective layer was carried out by means of dip coating method.

EXAMPLES 5 to 8

The same procedures as Examples 1 to 4 were followed except that a colloid solution of fine particles of antimony pentoxide dispersed in isopropyl alcohol (Sun Colloid, trade name, made by Nissan Chemical Industries, Ltd., solid component content 20% by weight) was used in place of the antimony-doped tin oxide fine powder. The colloid solution was compounded in the silicone resin series coating solution in the aforesaid examples such that the ratio of the resin solid components (P) in the coating composition to the solid components (M) in the colloid solution, P:M became 100:60 by weight ratio. The resulting mixture was mixed in a ball mill for one hour. Four kinds of electrophotographic photosensitive elements were prepared.

EXAMPLES 9 to 12

The procedures of Examples 1 to 4 were followed except that a colloid solution of solid solution particles of tin oxide and antimony oxide (containing 10% by weight antimony, particle sizes 10 to 20 nm) dispersed in isopropyl alcohol as a dispersion medium in a state being negatively charged by the presence of 9 parts by weight of silicon oxide particles per 100 parts by weight of the solid solution particles (the colloid solution, made by Nissan Chemical Industries, Ltd.) was used in place of the aforesaid antimony-doped tin oxide powder. The colloid solution was compounded with the silicone series coating composition as used in Examples 1 to 4 such that the ratio of the resin solid components (P) in the coating composition to the solid components (M) in the colloid solution P:M became 100:60 by weight ratio. The resulting mixture was mixed in a ball mill for one hour. Four kinds of electrophotographic photosensitive elements were prepared.

COMPARATIVE EXAMPLE 1

The procedures of Examples 1 to 4 were followed as described above except that 10 parts by weight of a butyletherified melamine-formaldehyde resin (UBAN 128, trade name, made by Mitsui Cynamide K.K.) was used in place of the methyl-butyl mixed etherified melamine-formaldehyde resin. An electrophotographic photosensitive element was prepared.

COMPARATIVE EXAMPLE 2

The procedures of Examples 1 to 4 were followed as described above except that 10 parts by weight of polyvinyl chloride (Y5-N, trade name, made by The Nippon Synthetic Chemical Industry, Ltd.) was used in place of the methyl-butyl mixed etherified melamine-formaldehyde resin. An electrophotographic photosensitive element was prepared.

COMPARATIVE EXAMPLE 3

The same procedures of Examples 1 to 4 were followed except that the methyl-butyl mixed etherified melamine-formaldehyde resin was not added to the surface protective layer. An electrophotographic photosensitive element was prepared.

COMPARATIVE EXAMPLES 6

The procedures of Examples 1 to 4 were followed as described above except that 10 parts by weight of a butyletherified melamine-formaldehyde resin (UBAN 128, made by Mitsui Cynamide K.K.) and 10 parts by weight of a methyletherified melamine-formaldehyde resin (Cymel 370, trade name, made by Mitsui Cynamide K.K.) were used in place of the methyl-butyl mixed etherified melamine-formaldehyde resin. An electrophotographic photosensitive element was prepared.

The following tests were applied to the electrophotographic photosensitive elements prepared in the aforesaid examples and comparative examples.

SURFACE POTENTIAL MEASUREMENT

Each electrophotographic photosensitive element was mounted on an electrostatic copying test apparatus (Gentec Cynthia 30M Type, made by Gentec), the surface thereof was positively charged, and the surface potential $V_1$ s p. (V) was measured.

MEASUREMENT OF HALF DECAY EXPOSURE AMOUNT AND RESIDUAL POTENTIAL

Each electrophotographic photosensitive element in the electrostatically charged state was exposed using a halogen lamp which was the exposure light source of the electrostatic copying test apparatus under the conditions of an exposure intensity of 0.92 mW/cm$^2$ and an exposure time of 60 msec. The time required for lowering the aforesaid surface potential $V_1$ S.p. to $\frac{1}{2}$ thereof was determined, and the half decay exposure amount $E_{\frac{1}{2}}$ (lux.sec.) was calculated.

Also, the surface potential after 0.4 seconds from the initiation of the light exposure was measured as the residual potential V r.p. (V).

Measurement of the Change of Surface Potential After Repeated Light Exposure Each electrophotographic photosensitive element was mounted on a copying apparatus (DC-111 Type, made by Mita Industrial Co., Ltd.) and the surface potential thereof after copying 500 copies was measured as the surface potential $V_2$ s.p. (V) after repeated light exposure.

From the aforesaid surface potential measured value $V_1$ s.p. and the surface potential measured value $V_2$ s.p. after repeated light exposure, the surface potential changed value $-\Delta V$ (V) was calculated by equation (I):

$$-\Delta V(V) = V_2\,s.p.\ (V) - V_1\,s.p.\ (V) \qquad \text{(I)}$$

Abrasion Resistance Test

Each electrophotographic photosensitive element was mounted on a drum type abrasion test apparatus (made by Mita Industrial Co., Ltd.) and an abrasion test paper (Imperial Wrapping Film, made by Sumitomo 3M Limited, a film having attached on the surface an aluminum oxide powder having particle sizes of 12 μm was mounted on a abrasion test paper mount ring on the drum abrasion test apparatus. This ring rotates once while the photosensitive element rotates 1,000 times. The abraded amount (μm) of the photosensitive element was measured when the photosensitive element was rotated 100 times while pressing the abrasion test paper onto the surface of the photosensitive element at a line pressure of 10 g/mm.

External Appearance

The external appearance of the surface protective layer was visually observed.

The measurements results which were obtained from these tests are shown in Table 1 below.

TABLE 1

| | Composition | | | Measurement results | | | | | | |
|---|---|---|---|---|---|---|---|---|---|---|
| | Kind*1 | Compounding Amount (part by weight) | Electric Conductivity*2 Impacting Agent | $V_1$s.p. (V) | $V_2$s.p. (V) | $-\Delta V$ (V) | Vr.p. (V) | $E_{\frac{1}{2}}$ (lux · sec.) | Abrased Amount (μm) | Appearance |
| Invention 1 | MBEMH | 0.1 | A | 739 | 718 | −21 | 148 | 3.8 | 0.6 | Normal |
| Invention 2 | MBEMH | 10 | A | 738 | 716 | −22 | 152 | 3.7 | 0.5 | " |
| Invention 3 | MBEMH | 20 | A | 744 | 724 | −20 | 151 | 3.6 | 0.6 | " |

TABLE 1-continued

| | Composition | | | Measurement results | | | | | | |
|---|---|---|---|---|---|---|---|---|---|---|
| | Kind*1 | Compounding Amount (part by weight) | Electric Conductivity*2 Impacting Agent | $V_1$s.p. (V) | $V_2$s.p. (V) | $-\Delta V$ (V) | Vr.p. (V) | $E_{\frac{1}{2}}$ (lux · sec.) | Abrased Amount (μm) | Appearance |
| Invention 4 | MBEMH | 30 | A | 738 | 721 | −17 | 146 | 3.7 | 0.7 | " |
| Invention 5 | MBEMH | 0.1 | B | 739 | 718 | −21 | 140 | 3.4 | 0.6 | " |
| Invention 6 | MBEMH | 10 | B | 747 | 725 | −22 | 142 | 3.5 | 0.6 | " |
| Invention 7 | MBEMH | 20 | B | 751 | 731 | −20 | 136 | 3.3 | 0.5 | " |
| Invention 8 | MBEMH | 30 | B | 760 | 740 | −20 | 138 | 3.4 | 0.7 | " |
| Invention 9 | MBEMH | 0.1 | C | 761 | 738 | −23 | 131 | 3.2 | 0.6 | " |
| Invention 10 | MBEMH | 10 | C | 738 | 717 | −21 | 133 | 3.3 | 0.7 | " |
| Invention 11 | MBEMH | 20 | C | 744 | 726 | −18 | 140 | 3.3 | 0.6 | " |
| Invention 12 | MBEMH | 30 | C | 746 | 723 | −23 | 130 | 3.1 | 0.7 | " |
| Comparison 1 | BEMH | 10 | A | 751 | 632 | −119 | 159 | 3.8 | 0.6 | Normal |
| Comparison 2 | PVAc | 10 | A | 739 | 720 | −19 | 176 | 4.0 | 0.8 | " |
| Comparison 3 | — | 0 | A | 738 | 690 | −48 | 168 | 3.9 | 1.1 | " |
| Comparison 4 | MBEMH | 0.05 | A | *3— | — | — | — | — | — | Crack occurred |
| Comparison 5 | MBEMH | 35 | A | *3— | — | — | — | — | — | " |
| Comparison 6 | BEMH + MEMH | 10 + 10 | A | *3— | — | — | — | — | — | " |

*1 MBEMH: Methyl-butyl mixed etherified melamine-formaldehyde resin
MEMH: Methyletherified melamine-formaldehyde resin
BEMH: Butyletherified melamine-formaldehyde resin
PVAc: Polyvinyl acetate
*2 A: Antimony-doped tin oxide fine powder
B: Antinaonyl pentaoxide colloid solution
C: Colloid solution of solid solution of tin oxide and antimony oxide
*3 Measurement impossible caused by the occurrence of cracks From the results shown in Table 1, it can be seen that in the electrophotographic photosensitive elements of Examples 1 to 12, the surface potential changed amount after repeated light exposure is much smaller compared to the sample of Comparative Example 1 using the butyletherified melamine-formaldehyde resin for the surface protective layer. From this fact, it can be estimated that in the surface protective layers in Examples 1 to 12 described above, the compatibility of the silicone site and the melamine site in each layer is good and each surface protective layer is a compact layer having less structural traps. Also, it has been found that in the composition of each surface protective layer in the above examples, even when 30 parts by weight of the methyl-butyl mixed etherified melamine-formaldehyde resin was compounded, a uniform layer without cracks can be formed.

In the electrophotographic photosensitive elements in Examples 1 to 12 described above, the surface potential changed amount after repeated light exposure, the residual potential, and the half decay exposure amount are less than those of the electrophotographic sensitive element in Comparative Example 3. From this fact, it has been confirmed that by compounding the methyl-butyl mixed etherified melamine-formaldehyde resin, the sensitivity characteristics of the electrophotographic photosensitive element are improved.

Also, from the results of the abrasion resistance test, it has been confirmed that the surface protective layers in Examples 1 to 12 provide excellent abrasion resistance compared with the case of Comparative Example 3 which uses no melamine-formaldehyde resin and Comparative Example 2 which uses polyvinyl acetate.

Furthermore, the results of Examples 1 to 12 and Comparative Examples 4 and 5, confirm that when the amount of the methyl-butyl mixed etherified melamine-formaldehyde resin is outside the range of from 0.1 to 30 parts by weight per 100 parts by weight of the non-volatile solid components of the silicone resin, a uniform and clean layer can not be formed.

Also, the results of Comparison Example 6, confirm that when the methyletherified melamine-formaldehyde resin and the butyletherified melamine-formaldehyde resin are used together, cracks occur in the surface protective layer. Thus, by using both of the resins only, a uniform layer can not be formed.

The measurement results in Examples 1 to 4 and Examples 5 to 12 confirm that when a colloid solution of an electrically conductive metal oxide particles is used as an electric conductivity imparting agent, the dispersibility is better when it is formed by stirring the mixture of the colloid solution and the coating composition, than dispersibility obtained when the conductive metal oxide is used in the form of fine particles which are stirred for 150 hours.

EXAMPLES 13 to 16, COMPARATIVE EXAMPLES 7 and 8

A coating composition for charge transfer layer composed of 100 parts by weight of polyacrylate (U-100, trade name, made by Unitika, Ltd.) as a binder resin, 100 parts by weight of 4-(N,N-diethylamino)benzaldehyde-N,N-diphenylhydrazone as a charge transfer material, and 900 parts by weight of methylene chloride ($CH_2Cl_2$) as a solvent was prepared. The coating composition was coated on an aluminum tube having an outside diameter of 78 mm and a length of 340 mm and was dried by heating for 30 minutes at 90° C. to form a charge transfer layer having a thickness of about 20 μm.

A coating composition for a charge layer composed of 80 parts by weight of 2,7-dibromoanthanthron (made by Imperial Chemical Industries, Limited), 20 parts by weight of metal free phthalocyanlne (made by BASF A.G.) as a charge generating material, 50 parts by weight of polyvinyl acetate (Y5-N, trade name made by Nippon Synthetic Chemical Industry Co., Ltd.) as a binder resin, and 2,000 parts by weight of diacetone alcohol as a solvent was coated on the aforesaid charge transfer layer and dried by heating for 30 minutes at 110° C. to form a charge generating layer having a thickness of about 0.5 μm.

57.4 parts by weight of 0.02N hydrochloric acid was mixed with 36 parts by weight of isopropyl alcohol and after slowly adding dropwise thereto 80 parts by weight of methyltrimethoxysilane and 20° parts by weight of glycidoxypropyltrimethoxysilane while stirring the mixture at a temperature of from 20 to 25° C., the resulting mixture was allowed to stand for one hour at room temperature to provide a silane hydrolyzed product solution. Then, an acrylic acid ester-methacrylic acid ester copolymer (Aloron 450, trade name, made by Nippon Shokubai Kagaku Kogyo Co., Ltd., average molecular weight 5,000 to 6,000) was compounded with the silane hydrolyzed product solution in each amount shown in Table 2 below per 100 parts by weight of the non-volatile components in the solution in order to provide a coating composition for a surface protective layer.

An antimony-doped tin oxide fine powder (made by Sumitomo Cement Co., Ltd., solid solution particles of tin oxide and antimony oxide, containing 10% by weight antimony, particle size; 5 to 10 nm) was mixed with the aforesaid coating composition in an amount of 50 parts by weight per 100 parts by weight of the resin solid components in the coating composition. After further adding thereto 0.3 part of a silicone series surface active agent, the resulting mixture was mixed for 150 hours in a ball mill. Then, 0.5 part by weight of triethylamine were added to the mixture of the coating composition and the antimony-doped tin oxide fine particles, and the resulting mixture was coated on the charge generating layer and set by heating for one hour at 110° C. to form a surface protective layer having a thickness of about 2.5 μm. Four kinds of drum type electrophotographic photosensitive elements, each having a laminated type photosensitive layer were prepared.

COMPARATIVE EXAMPLES 9 and 10

The procedures of Examples 13 to 16 were followed except that a polyacrylate (Dianal BR105, trade name, made by Mitsubishi Rayon Co., Ltd.) having an average molecular weight of 55,000 was used in place of the acrylic acid ester-methacrylic acid ester copolymer having an average molecular weight of 5,000 to 6,000, four kinds of electrophotographic photosensitive elements were prepared.

COMPARISON EXAMPLES 11 AND 12

The same procedures of Examples 13 to 16 were followed except that polyacrylate having an average molecular weight of 8,000 was used in place of the acrylic acid ester-methacrylic acid ester copolymer having an average molecular weight of 5,000 to 6,000. Two kinds of electrophotographic photosensitive elements were prepared.

On the electrophotographic photosensitive elements prepared in the aforesaid examples and comparative examples, the tests performed on Examples 1 to 12 and Comparative Examples 1 to 6 described above were applied. The results obtained are shown in Table 2 below.

TABLE 2

| | Acrylic Polymer | | Measurement Result | | | | | |
|---|---|---|---|---|---|---|---|---|
| | Kind*1 | Compounding Amount (part by weight) | $V_{1s.p.}$ (V) | $V_{2s.p.}$ (V) | $-\Delta V$ (V) | $E_{\frac{1}{2}}$ (lux · sec) | Abrased Amount (μm) | Appearance |
| Invention 13 | A | 0.1 | 764 | 732 | −32 | 3.8 | 0.8 | Normal |
| Invention 14 | A | 10 | 749 | 718 | −31 | 3.7 | 1.0 | " |
| Invention 15 | A | 15 | 754 | 725 | −29 | 3.6 | 1.2 | " |
| Invention 16 | A | 30 | 738 | 718 | −20 | 3.8 | 1.4 | " |
| Comparison 7 | A | 0.01 | 746 | *2— | — | — | — | Crack occurred |
| Comparison 8 | A | 35 | 738 | 690 | −48 | 3.4 | 2.8 | Normal |
| Comparison 9 | B | 15 | 760 | 684 | −76 | 3.9 | 1.0 | " |
| Comparison 10 | B | 30 | 747 | 660 | −87 | 3.9 | 2.4 | " |
| Comparison 11 | | 15 | 755 | 700 | −55 | 3.8 | 0.9 | " |
| Comparison 12 | | 30 | 747 | 697 | −50 | 3.9 | 0.8 | " |

*1 A: Arolon 450
B: Dianal BR105
*2 Crack occurred after repeated light exposure, whereby the measurement could not be conducted.

From the results shown in Table 2, it has been confirmed that the coatings of the present invention provide superior performance. In the electrophotographic photosensitive elements of Examples 13 to 16, the surface potential changed amount after repeated light exposure is small and the abraded amount is small compared to the electrophotographic photosensitive elements in Comparative Examples 9 and 10. The latter comparative examples contain an acrylic polymer having an average molecular weight of over 6,000 in the surface protective layer. The surface protective layers in Examples 13 to 16 are uniform and the photosensitive elements in these examples possess excellent physical properties and sensitivity characteristics.

Also, from the results in examples 13 to 16 and Comparative Examples 7 and 8, it has been confirmed that when the amount of the acrylic polymer in the coating composition is less than 0.1 part by weight, the physical properties of the surface protective layer are deteriorated. When the content is over 30 parts by weight, the sensitivity characteristics of the photosensitive elements are deteriorated.

When the electrophotographic photosensitive element of this invention is constructed as described above, the brittleness to sliding friction of the photosensitive element is improved compared to the case where a thermosetting silicone resin is used alone as the surface protective layer. The present invention does not exert bad influences on the sensitivity characteristics and physical properties of the electrophotographic photosensitive element. In addition, the photosensitive element of the present invention has a surface protective layer which has excellent electric conductivity.

When electrically conductive metal oxide particles as an electric conductivity imparting agent are mixed with the coating composition for the surface protective layer in the form of a colloid solution, the conductive metal oxide particles are easily dispersed uniformly in the surface protective layer.

EXAMPLES 17 TO 22, COMPARATIVE EXAMPLES 13 TO 28

A coating composition for charge transfer layer composed of 100 parts by weight of polyarylate (U-100, trade name, made by Unitika Ltd.) as a binder resin, 100 parts by weight of 4-(N,N-diethylalmino)benzaldehyde-N,N-diphenylhydrazone as a charge transfer material, and 900 parts by weight of methylene chloride ($CH_2Cl_2$) as a solvent was prepared, and the coating composition was coated on an aluminum tube having an outer diameter of 78 mm and a length of 340 mm followed by drying by heating for 30 minutes at 90° C. to form a charge transfer layer having a thickness of about 20 μm.

Then, a coating composition for charge generating layer composed of 80 parts by weight of 2,7-dibromoanthanthrone (made by Imperial Chemical Industries, Limited) as a charge generating material, 20 parts by weight of metal free phthalocyanine (made by BASF A.G.) as a charge generating material, 50 parts by weight of polyvinyl acetate (Y5-N, trade name, made by The Nippon Synthetic Chemical Industry Co., Ltd.) as a binder resin, and 2,000 parts by weight of diacetone alcohol as a solvent was coated on the charge transfer layer and dried by heating for 30 minutes at 110° C. to form a charge generating layer having a thickness of about 0.5 μm.

Then, 57.4 parts by weight of 0.02N hydrochloric acid was mixed with 36 parts by weight of isopropyl alcohol and after adding dropwise thereto slowly 80 parts by weight of methyltrimethoxysilane and 20 parts by weight of glycidoxypropylmethoxysilane while stirring at a temperature of from 20° to 25° C. The resulting mixture was allowed to stand for one hour at room temperature to provide a solution of Silane hydrolyzed product.

Then, the silane hydrolyzed product solution was mixed with a specific etherified melamine-formaldehyde resin in each amount shown in Table 3 and polyvinylbutyral (produced by Denka Chemical Co., Ltd., Denkabutyral 5000A) in an amount shown in Table 3 to a total amount of the non-volatile solid components in the silane hydrolyzed product solution and the specific etherified melamine-formaldehyde resin to provide a coating composition for a surface protective layer.

A fine powder of antimony-doped tin oxide (made by Sumitomo Cement Co., Ltd., solid solution particles of tin oxide and antimony oxide, containing 10% by weight antimony, particle size; 5 to 10 nm) was compounded with the coating composition in an amount of 60 parts by weight per 100 parts by weight of the resin solid components in the coating composition and the resulting mixture was mixed in a ball mill for 150 hours. The mixture of the coating composition and the antimony-doped tin oxide fine powder was coated on the charge generating layer and set by heating for one hour at 110° C. to form a surface protective layer having a thickness of about 2.5 μm. 22 kinds of drum-type electrophotographic photosensitive elements were prepared with each having the lamination type photosensitive layer.

EXAMPLES 23 TO 26

The same procedures of Examples 17 to 22 were followed except that a colloid solution of fine particles of antimony pentoxide dispersed in isopropyl alcohol (Sun Colloid, trade name, made by Nissan Chemical Industries, Ltd., solid component content 20% by weight) was used in place of the antimony-doped tin oxide fine powder. The colloid solution was compounded in silicone resin series coating solution in the aforesaid examples such that the ratio of the resin solid components (P) in the coating composition to the solid components (M) in the colloid solution, P:M became 100:60 by weight ratio. The resulting mixture was mixed in a ball mill for one hour. Four kinds of electrophotographic photosensitive elements were prepared.

EXAMPLES 27 TO 34

The same procedures of Examples 17 to 22 were followed except that a colloid solution of solid solution particles of tin oxide and antimony oxide (containing 10% by weight antimony, particle sizes 10 to 20 nm) dispersed in isopropyl alcohol as a dispersion medium in a state being negatively charged by the presence of 9 parts by weight of silicon oxide particles per 100 parts by weight of the solid solution particles (the colloid solution, made by Nissan Chemical Industries, Ltd.) was used in place of the antimony-doped tin oxide powder. The colloid solution was compounded with the aforesaid silicone series coating composition such that the ratio of the resin solid components (P) in the coating composition to the solid components (M) in the colloid solution P:M became 100:60 by weight ratio. The resulting mixture was mixed in a ball mill for one hour. Eight kinds of electrophotographic photosensitive elements were prepared.

Comparative Example 29

The same procedures of Examples 17 to 22 described above were followed except that a silicone resin based coating composition (Tosguard 520, trade name, made by Toshiba Silicone Co., Ltd.) was used as a coating composition for the surface protective layer. An electrophotographic photosensitive element was prepared.

EXAMPLES 35 TO 44 AND COMPARATIVE EXAMPLES 30 TO 45

The same procedure of Examples 17 to 22 described above were followed except that a polyvinyl chloride (Y5-N, trade name, made by The Nippon Synthetic Chemical Industry, Ltd.) in each amount shown in Table 4 was used in place of the polybutyral resin. The electrophotographic photosensitive elements were prepared.

EXAMPLES 45 TO 48

The same procedures of Examples 35 to 44 were followed except that a colloid solution of fine particles of antimony pentaoxide dispersed in isopropyl alcohol (Sun Colloid, trade name, made by Nissan Chemical Industries, Ltd., solid component content 20% by weight) was used in place of the antimony-doped tin oxide fine powder. The colloid solution was compounded in silicone resin series coating solution in the aforesaid examples such that the ratio of the reason solid components (P) in the coating composition to the solid components (M) in the colloid solution, P:M became 100:60 by weight ratio. The resulting mixture was mixed in a ball mill for one hour. Four kinds of electrophotographic photosensitive elements were prepared.

EXAMPLES 49 TO 56

The same procedures of Examples 17 to 22 were followed except that a colloid solution of solid solution particles of tin oxide and antimony oxide (containing 10% by weight antimony, particle sizes 10 to 20 nm) dispersed in isopropyl alcohol as a dispersion medium in a state being negatively charged by the presence of 9 parts by weight of silicon oxide particles per 100 parts by weight of the solid solution particles (the colloid solution, made by Nissan Chemical Industries, Ltd.) was used in place of the aforesaid antimony-doped tin oxide powder. The colloid solution was compounded with the silicone series coating solution in the aforesaid examples such that the ratio of the resin solid components (P) in the coating composition to the solid components (M) in the colloid solution P:M became 100:60 by weight ratio, and the resultant mixture was mixed in a ball mill for one hour. Eight kinds of electrophotographic photosensitive elements were prepared.

EXAMPLES 57 TO 68 AND Comparative EXAMPLES 46 TO 61

The same procedures of Examples 17 to 22 were followed except that an acryl based copolymer (BR-105, trade name, made by Mitubishi Rayon Co., Ltd.) was used in each amount shown in Table 5 in place of polyvinylbutyral resin. Electrophotographic photosensitive elements were prepared.

EXAMPLES 69 to 72

The same procedures of Examples 57 to 68 were followed except that a colloid solution of fine particles of antimony pentaoxide dispersed in isopropyl alcohol (Sun Colloid, trade name, made by Nissan Chemical Industries, Ltd., solid component content 20% by weight) was used in place of the antimony-doped tin oxide fine powder. The colloid solution was compounded in silicone resin series coating solution in the aforesaid examples such that the ratio of the reason solid components (P) in the coating composition to the solid components (M) in the colloid solution, P:M became 100:60 by weight ratio. The resulting mixture was mixed in a ball mill for one hour. Four kinds of electrophotographic photosensitive elements were prepared.

EXAMPLES 73 TO 80

The same procedures of Examples 57 to 68 were followed except that a colloid solution of solid solution particles of tin oxide and antimony oxide (containing 10% by weight antimony, particle sizes 10 to 20 nm) dispersed in isopropyl alcohol as a dispersion medium in a state being negatively charged by the presence of 9 parts by weight of silicon oxide particles per 100 parts by weight of the solid solution particles (the colloid solution, made by Nissan Chemical Industries, Ltd.) was used in place of the foresaid antimony-doped tin oxide powder. The colloid solution was compounded with the silicone series coating composition in the aforesaid examples such that the ratio of the resin solid components (P) in the coating composition to the solid components (M) in the colloid solution P M became 100:60 by weight ratio. The resulting mixture was mixed in a ball mill for one hour. Four kinds of electrophotographic photosensitive elements were prepared.

On the electrophotographic photosensitive elements prepared in examples 17 to 80 and comparative examples 13 to 61, the tests as in Examples 1 to 12 and Comparative Examples 1 to 6 described above were applied. The results obtained are shown in Tables 3 to 5 below.

TABLE 3

| | Composition | | | | | Measurement Results | | | | |
|---|---|---|---|---|---|---|---|---|---|---|
| | Melamine.formaldehyde Resin | | Thermoplastic Resin | | Electric | | | | | |
| | Kind*1 | Compounding Amount (part by weight) | Kind*2 | Compounding Amount (part by weight) | Conductivity*3 Impacting Agent | $V_{1s.p.}$ (V) | Vr.p. (V) | $E_{\frac{1}{2}}$ (lux · sec.) | Abrased Amount (μm) | Appearance |
| Example | | | | | | | | | | |
| 17 | MEMH | 5 | PVB | 1.05 | A | 760 | 163 | 3.8 | 1.2 | Normal |
| 18 | MEMH | 25 | PVB | 1.04 | A | 751 | 162 | 3.8 | 1.4 | Normal |
| 19 | MEMH | 50 | PVB | 1.0 | A | 763 | 160 | 3.6 | 1.3 | Normal |
| 20 | MEMH | 5 | PVB | 10.5 | A | 752 | 158 | 3.7 | 1.1 | Normal |
| 21 | MEMH | 25 | PVB | 10.4 | A | 748 | 156 | 3.6 | 1.2 | Normal |
| 22 | MEMH | 50 | PVB | 10 | A | 739 | 154 | 3.5 | 1.1 | Normal |
| 23 | MEMH | 10 | PVB | 4.55 | B | 764 | 128 | 3.0 | 1.2 | Normal |
| 24 | MEMH | 20 | PVB | 6.67 | B | 755 | 126 | 3.1 | 1.3 | Normal |
| 25 | MBEMH | 10 | PVB | 4.55 | B | 748 | 120 | 2.8 | 1.1 | Normal |
| 26 | MBEMH | 20 | PVB | 6.67 | B | 755 | 122 | 2.9 | 1.3 | Normal |
| 27 | MEMH | 10 | PVB | 4.55 | C | 751 | 132 | 3.2 | 1.4 | Normal |
| 28 | MEMH | 20 | PVB | 6.67 | C | 744 | 136 | 3.3 | 1.1 | Normal |
| 29 | MBEMH | 10 | PVB | 4.55 | C | 746 | 124 | 3.0 | 1.3 | Normal |
| 30 | MBEMH | 20 | PVB | 6.67 | C | 754 | 126 | 3.1 | 1.4 | Normal |
| 31 | MEMH | 10 | PVB | 4.55 | C | 754 | 160 | 3.8 | 1.4 | Normal |
| 32 | MEMH | 20 | PVB | 6.67 | C | 748 | 164 | 3.6 | 1.3 | Normal |
| 33 | MBEMH | 10 | PVB | 4.55 | C | 741 | 168 | 3.7 | 1.2 | Normal |
| 34 | MBEMH | 20 | PVB | 6.67 | C | 762 | 166 | 3.6 | 1.3 | Normal |
| Comparative Example | | | | | | | | | | |
| 13 | MEMH | 5 | PVB | 0.95 | A | 763 | 208 | 5.1 | 1.8 | Normal |
| 14 | MEMH | 50 | PVB | 0.87 | A | *4— | — | — | — | Crack occurred |
| 15 | MBEMH | 5 | PVB | 0.95 | A | 748 | 212 | 5.0 | 2.0 | Normal |
| 16 | MBEMH | 50 | PVB | 0.87 | A | *4— | — | — | — | Crack occurred |
| 17 | MEMH | 5 | PVB | 12.4 | A | *5— | — | — | — | White Turbidity |
| 18 | MEMH | 50 | PVB | 11.3 | A | *4— | — | — | — | Crack occurred |
| 19 | MBEMH | 5 | PVB | 12.4 | A | *5— | — | — | — | White Turbidity |

TABLE 3-continued

| | Composition | | | | | Measurement Results | | | | |
|---|---|---|---|---|---|---|---|---|---|---|
| | Melamine.formaldehyde Resin | | Thermoplastic Resin | | Electric Conductivity*3 Impacting Agent | | | | | |
| | Kind*1 | Compounding Amount (part by weight) | Kind*2 | Compounding Amount (part by weight) | | $V_{1s.p.}$ (V) | Vr.p. (V) | $E_{\frac{1}{2}}$ (lux · sec.) | Abrased Amount (μm) | Appearance |
| 20 | MBEMH | 50 | PVB | 11.3 | A | *4— | — | — | — | Crack occurred |
| 21 | MEMH | 3 | PVB | 0.97 | A | *4— | — | — | — | Crack occurred |
| 22 | MEMH | 60 | PVB | 0.81 | A | *4— | — | — | — | Crack occurred |
| 23 | MBEMH | 3 | PVB | 0.97 | A | *4— | — | — | — | Crack occurred |
| 24 | MBEMH | 60 | PVB | 0.81 | A | *4— | — | — | — | Crack occurred |
| 25 | MEMH | 3 | PVB | 12.6 | A | *5— | — | — | — | White Turbidity |
| 26 | MEMH | 60 | PVB | 10.6 | A | *4— | — | — | — | Crack occurred |
| 27 | MBEMH | 3 | PVB | 12.6 | A | *5— | — | — | — | White Turbidity |
| 28 | MBEMH | 60 | PVB | 10.6 | A | *4— | — | — | — | Crack occurred |
| 29 | — | — | — | — | A | 750 | 268 | 8.6 | 2.9 | Normal |

TABLE 4

| | Composition | | | | | Measurement Results | | | | |
|---|---|---|---|---|---|---|---|---|---|---|
| | Melamine.formaldehyde Resin | | Thermoplastic Resin | | Electric Conductivity*3 Impacting Agent | | | | | |
| | Kind*1 | Compounding Amount (part by weight) | Kind*2 | Compounding Amount (part by weight) | | $V_{1s.p.}$ (V) | Vr.p. (V) | $E_{\frac{1}{2}}$ (lux · sec.) | Abrased Amount (μm) | Appearance |
| Example | | | | | | | | | | |
| 35 | MEMH | 5 | PVAc | 1.05 | A | 737 | 139 | 3.4 | 0.5 | Normal |
| 36 | MEMH | 25 | PVAc | 1.04 | A | 744 | 137 | 3.3 | 0.4 | Normal |
| 37 | MEMH | 50 | PVAc | 1.0 | A | 757 | 131 | 3.2 | 0.4 | Normal |
| 38 | MEMH | 5 | PVAc | 10.5 | A | 764 | 132 | 3.3 | 0.5 | Normal |
| 39 | MEMH | 25 | PVAc | 10.4 | A | 755 | 129 | 3.2 | 0.5 | Normal |
| 40 | MEMH | 50 | PVAc | 10 | A | 747 | 126 | 3.1 | 0.3 | Normal |
| 41 | MBEMH | 5 | PVAc | 1.05 | A | 759 | 124 | 3.1 | 0.4 | Normal |
| 42 | MBEMH | 50 | PVAc | 10 | A | 754 | 120 | 3.0 | 0.5 | Normal |
| 43 | MBEMH | 5 | PVAc | 1.05 | A | 744 | 122 | 3.1 | 0.4 | Normal |
| 44 | MBEMH | 50 | PVAc | 10 | A | 753 | 121 | 3.0 | 0.3 | Normal |
| 45 | MEMH | 10 | PVAc | 4.55 | B | 747 | 106 | 2.4 | 0.4 | Normal |
| 46 | MEMH | 20 | PVAc | 6.67 | B | 761 | 117 | 2.6 | 0.5 | Normal |
| 47 | MBEMH | 10 | PVAc | 4.55 | B | 750 | 110 | 2.5 | 0.4 | Normal |
| 48 | MBEMH | 20 | PVAc | 6.67 | B | 747 | 108 | 2.6 | 0.6 | Normal |
| 49 | MEMH | 10 | PVAc | 4.55 | C | 744 | 120 | 2.7 | 0.3 | Normal |
| 50 | MEMH | 20 | PVAc | 6.67 | C | 738 | 118 | 2.8 | 0.4 | Normal |
| 51 | MBEMH | 10 | PVAc | 4.55 | C | 750 | 120 | 2.8 | 0.5 | Normal |
| 52 | MBEMH | 20 | PVAc | 6.67 | C | 743 | 116 | 2.7 | 0.6 | Normal |
| 53 | MEMH | 10 | PVAc | 4.55 | C | 739 | 134 | 3.0 | 0.4 | Normal |
| 54 | MEMH | 20 | PVAc | 6.67 | C | 747 | 136 | 3.1 | 0.3 | Normal |
| 55 | MBEMH | 10 | PVAc | 4.55 | C | 740 | 130 | 3.0 | 0.4 | Normal |
| 56 | MBEMH | 20 | PVAc | 6.67 | C | 738 | 128 | 2.9 | 0.5 | Normal |
| Comparative Example | | | | | | | | | | |
| 30 | MEMH | 5 | PVAc | 0.95 | A | *4— | — | — | — | Crack occurred |
| 31 | MEMH | 50 | PVAc | 0.87 | A | *4— | — | — | — | Crack occurred |
| 32 | MBEMH | 5 | PVAc | 0.95 | A | *4— | — | — | — | Crack occurred |
| 33 | MBEMH | 50 | PVAc | 0.87 | A | *4— | — | — | — | Crack occurred |
| 34 | MEMH | 5 | PVAc | 12.4 | A | *5— | — | — | — | White Turbidity |
| 35 | MEMH | 50 | PVAc | 11.3 | A | *4— | — | — | — | Crack occurred |
| 36 | MBEMH | 5 | PVAc | 12.4 | A | *5— | — | — | — | White Turbidity |
| 37 | MBEMH | 50 | PVAc | 11.3 | A | *4— | — | — | — | Crack occurred |
| 38 | MEMH | 3 | PVAc | 0.97 | A | *4— | — | — | — | Crack occurred |
| 39 | MEMH | 60 | PVAc | 0.81 | A | *4— | — | — | — | Crack occurred |

TABLE 4-continued

| | Composition | | | | | Measurement Results | | | | |
|---|---|---|---|---|---|---|---|---|---|---|
| | Melamine.formaldehyde Resin | | Thermoplastic Resin | | Electric Conductivity*3 Impacting Agent | | | | | |
| | Kind*1 | Compounding Amount (part by weight) | Kind*2 | Compounding Amount (part by weight) | | $V_{1s.p.}$ (V) | Vr.p. (V) | $E_{\frac{1}{2}}$ (lux · sec.) | Abrased Amount (μm) | Appearance |
| 40 | MBEMH | 3 | PVAc | 0.97 | A | *4— | — | — | — | Crack occurred |
| 41 | MBEMH | 60 | PVAc | 0.81 | A | *4— | — | — | — | Crack occurred |
| 42 | MEMH | 3 | PVAc | 12.6 | A | *5— | — | — | — | White Turbidity |
| 43 | MEMH | 60 | PVAc | 10.6 | A | *4— | — | — | — | Crack occurred |
| 44 | MBEMH | 3 | PVAc | 12.6 | A | *5— | — | — | — | White Turbidity |
| 45 | MBEMH | 60 | PVAc | 10.6 | A | *4— | — | — | — | Crack occurred |

TABLE 5

| | Composition | | | | | Measurement Results | | | | |
|---|---|---|---|---|---|---|---|---|---|---|
| | Melamine.formaldehyde Resin | | Thermoplastic Resin | | Electric Conductivity*3 Impacting Agent | | | | | |
| | Kind*1 | Compounding Amount (part by weight) | Kind*2 | Compounding Amount (part by weight) | | $V_{1s.p.}$ (V) | Vr.p. (V) | $E_{\frac{1}{2}}$ (lux · sec.) | Abrased Amount (μm) | Appearance |
| Example | | | | | | | | | | |
| 57 | MEMH | 5 | A C | 1.05 | A | 742 | 121 | 2.8 | 1.4 | Normal |
| 58 | MEMH | 25 | A C | 1.04 | A | 747 | 119 | 2.8 | 1.0 | Normal |
| 59 | MEMH | 50 | A C | 1.0 | A | 736 | 115 | 2.6 | 0.8 | Normal |
| 60 | MEMH | 5 | A C | 10.5 | A | 751 | 119 | 2.9 | 1.3 | Normal |
| 61 | MEMH | 25 | A C | 10.4 | A | 763 | 118 | 2.8 | 0.9 | Normal |
| 62 | MEMH | 50 | A C | 10 | A | 754 | 111 | 2.7 | 0.7 | Normal |
| 63 | MBEMH | 5 | A C | 1.05 | A | 748 | 122 | 2.7 | 1.3 | Normal |
| 64 | MBEMH | 25 | A C | 1.04 | A | 738 | 118 | 2.7 | 1.1 | Normal |
| 65 | MBEMH | 50 | A C | 1.0 | A | 744 | 110 | 2.5 | 0.7 | Normal |
| 66 | MBEMH | 5 | A C | 10.5 | A | 748 | 119 | 2.8 | 1.4 | Normal |
| 67 | MBEMH | 25 | A C | 10.4 | A | 750 | 114 | 2.6 | 0.8 | Normal |
| 68 | MBEMH | 50 | A C | 10 | A | 764 | 112 | 2.5 | 0.6 | Normal |
| 69 | MEMH | 10 | A C | 4.55 | B | 740 | 98 | 2.2 | 1.0 | Normal |
| 70 | MEMH | 20 | A C | 6.67 | B | 739 | 101 | 2.3 | 0.9 | Normal |
| 71 | MBEMH | 10 | A C | 4.55 | B | 738 | 100 | 2.1 | 0.8 | Normal |
| 72 | MBEMH | 20 | A C | 6.67 | B | 761 | 101 | 2.2 | 0.9 | Normal |
| 73 | MEMH | 10 | A C | 4.55 | C | 760 | 108 | 2.4 | 0.9 | Normal |
| 74 | MEMH | 20 | A C | 6.67 | C | 754 | 111 | 2.3 | 0.7 | Normal |
| 75 | MBEMH | 10 | A C | 4.55 | C | 749 | 108 | 2.2 | 0.8 | Normal |
| 76 | MBEMH | 20 | A C | 6.67 | C | 751 | 106 | 2.2 | 0.9 | Normal |
| 77 | MEMH | 10 | A C | 4.55 | C | 741 | 128 | 2.7 | 1.0 | Normal |
| 78 | MEMH | 20 | A C | 6.67 | C | 766 | 126 | 2.8 | 0.8 | Normal |
| 79 | MBEMH | 10 | A C | 4.55 | C | 753 | 120 | 2.6 | 0.9 | Normal |
| 80 | MBEMH | 20 | A C | 6.67 | C | 755 | 122 | 2.7 | 0.8 | Normal |
| Comparative Example | | | | | | | | | | |
| 46 | MEMH | 5 | A C | 0.95 | A | 740 | 211 | 5.3 | 2.1 | Normal |
| 47 | MEMH | 50 | A C | 0.87 | A | *4— | — | — | — | Crack occurred |
| 48 | MBEMH | 5 | A C | 0.95 | A | 753 | 210 | 5.2 | 2.1 | Normal |
| 49 | MBEMH | 50 | A C | 0.87 | A | *4— | — | — | — | Crack occurred |
| 50 | MEMH | 5 | A C | 12.4 | A | 741 | 220 | 5.2 | 2.7 | Normal |
| 51 | MEMH | 50 | A C | 11.3 | A | *4— | — | — | — | Crack occurred |
| 52 | MBEMH | 5 | A C | 12.4 | A | 750 | 219 | 5.1 | 2.6 | Normal |
| 53 | MBEMH | 50 | A C | 11.3 | A | *4— | — | — | — | Crack occurred |
| 54 | MEMH | 3 | A C | 0.97 | A | *4— | — | — | — | Crack occurred |
| 55 | MEMH | 60 | A C | 0.81 | A | *4— | — | — | — | Crack occurred |
| 56 | MBEMH | 3 | A C | 0.97 | A | *4— | — | — | — | Crack occurred |
| 57 | MBEMH | 60 | A C | 0.81 | A | *4— | — | — | — | Crack occurred |
| 58 | MEMH | 3 | A C | 12.6 | A | 742 | 201 | 5.2 | 2.6 | Normal |
| 59 | MEMH | 60 | A C | 10.6 | A | *4— | — | — | — | Crack occurred |
| 60 | MBEMH | 3 | A C | 12.6 | A | 744 | 211 | 5.0 | 2.5 | Normal |
| 61 | MBEMH | 60 | A C | 10.6 | A | *4— | — | — | — | Crack |

TABLE 5-continued

| Composition | | | | | Measurement Results | | | | |
|---|---|---|---|---|---|---|---|---|---|
| Melamine.formaldehyde Resin | | Thermoplastic Resin | | Electric | | | | | |
| Kind*1 | Compounding Amount (part by weight) | Kind*2 | Compounding Amount (part by weight) | Conductivity*3 Impacting Agent | $V_1$s.p. (V) | Vr.p. (V) | $E_{\frac{1}{2}}$ (lux · sec.) | Abrased Amount (μm) | Appearance |
| | | | | | | | | | occurred |

*1 MBEMH: Methyl-butyl mixed etherified melamine-formaldehyde resin
MEMH: Methyletherified melamine-formaldehyde resin
BEMH: Butyletherified melamine-formaldehyde resin
PVAc: Polyvinyl acetate
*2 PVB: polyvinylbuthyral
PVAc: polyvinylacetate
AC: acrylic copolymer
*3 A: Antimony-doped tin oxide fine powder
B: Antinaonyl pentaoxide colloid solution
C: Colloid solution of solid solution of tin oxide and antomony oxide
*4 Measurement impossible caused by the occurrence of cracks
*5 Measurement impossible caused by the occurrence of white turbidity

What is claimed:

1. An electrophotographic photosensitive element comprising a photosensitive layer and a surface protective layer on the photosensitive layer;

wherein the surface protective layer is a heat-set coating formed from a mixture comprising a) a thermosetting silicone resin; and b) a methyl-butyl mixed etherified melamine-formaldehyde resin;

and wherein the thermosetting silicone resin comprises i) a solvent; and ii) a non-volatile solid component selected from the group consisting of a hydrolyzed product of silane series compounds and an initial condensation reaction product of silane series compounds;

and wherein the methyl-butyl mixed etherified melamine-formaldehyde resin is in an amount of from 0.1 to 30 parts by weight per 100 parts by weight of the non-volatile solid components of the thermosetting silicone resin.

2. An electrophotographic photosensitive element as claimed in claim 1, wherein said surface protective layer contains an electrically conductive material.

3. An electrophotographic photosensitive element as claimed in claim 2, wherein said electrically conductive material is an electrically conductive metal oxide in the form of fine particles.

4. An electrophotographic photosensitive element as claimed in claim 1, wherein the content of the non-volatile solid components of said thermosetting silicone resin in the surface protective layer is from 50 to 71 wt %.

5. An electrophotographic photosensitive element as claimed in claim 1, wherein the number average molecular weight of said methyl-butyl mixed etherified melamine-formaldehyde resin is from 1,000 to 1,500.

6. An electrophotographic photosensitive element comprising a photosensitive layer and surface protective layer on the photosensitive layer, wherein the surface protective layer is a heat-set coating formed from a mixture comprising a) a thermosetting silicone resin;

b) a methyl etherified melamine-formaldehyde resin and/or a methyl-butyl mixed etherified melamine-formaldehyde resin; and c) a thermoplastic resin;

and wherein the thermosetting silicone resin comprises i) a solvent; and ii) a non-volatile solid component selected from the group consisting of a hydrolyzed product of silane series compounds and an initial condensation reaction product of silane series compounds;

and wherein the methyl-etherified melamine-formaldehyde resin and/or the methyl-butyl mixed etherified melamine-formaldehyde resin is in an amount of from 0.1 to 50 parts by weight per 100 parts by weight of the non-volatile solid components of the thermosetting silicone resin;

and wherein the thermoplastic resin is in an amount of from 1 to 11 wt % to a total amount of the non-volatile solid components of the thermosetting silicone resin and the methyl etherified melamine-formaldehyde resin and/or the methyl-butyl mixed etherified melamine-formaldehyde resin.

7. An electrophotographic photosensitive element as claimed in claim 6, wherein said surface protective layer contains an electrically conductive material.

8. An electrophotographic photosensitive element as claimed in claim 7, wherein said electrically conductive material is an electrically conductive metal oxide in the form of fine particles.

9. An electrophotographic photosensitive element as claimed in claim 6, wherein the content of the non-volatile solid components of said thermosetting silicone resin in the surface protective layer is from 50 to 71 wt %.

10. An electrophotographic photosensitive element as claimed in claim 6, wherein said thermoplastic resin is an acrylic copolymer having an average molecular weight of 6,000 or less.

11. An electrophotographic photosensitive element as claimed in claim 10, wherein said acrylic copolymer having an average molecular weight of 6,000 or less is made of polymethyl methacrylate, polymethyl acrylate, or copolymers thereof.

12. An electrophotographic photosensitive element according to claim 11, wherein the methyl-etherified melamine-formaldehyde resin is in an amount of from 5 to 50 parts by weight per 100 parts of the non-volatile solid components of the thermosetting silicone resin.

* * * * *